US006305926B1

(12) United States Patent
Ray

(10) Patent No.: US 6,305,926 B1
(45) Date of Patent: Oct. 23, 2001

(54) DEVICE TO ASSIST IN APPLYING FILLER MATERIAL

(76) Inventor: Daniel F. Ray, 1343 E. 46th St., Tulsa, OK (US) 74105

( * ) Notice: Subject to any disclaimer, the term of this patent is extended or adjusted under 35 U.S.C. 154(b) by 0 days.

(21) Appl. No.: 09/231,120

(22) Filed: Jan. 15, 1999

Related U.S. Application Data

(60) Provisional application No. 60/071,772, filed on Jan. 18, 1998.

(51) Int. Cl.[7] ..... B05C 17/10

(52) U.S. Cl. ..... 425/458; 425/472; 15/235.7

(58) Field of Search ..... 425/458, 470, 425/472; 2/21; 15/235.7, 235.5; 223/101; D3/29

(56) References Cited

U.S. PATENT DOCUMENTS

| | | | | |
|---|---|---|---|---|
| 1,160,522 | | 11/1915 | Morris | 223/101 |
| 1,380,960 | | 6/1921 | Hmenia | 223/101 |
| 1,894,413 | | 1/1933 | Nenning et al. | 15/227 |
| 3,228,033 | | 1/1966 | Ames et al. | 2/21 |
| 3,511,242 | | 5/1970 | Agnone | 128/303 |
| 3,846,060 | * | 11/1974 | Otis | 425/458 |
| 3,905,113 | | 9/1975 | Jacob | 32/40 R |
| 4,127,222 | * | 11/1978 | Adams | 223/101 |
| 4,177,698 | | 12/1979 | Greneker | 81/1 R |
| 4,239,134 | | 12/1980 | Joy | 223/101 |
| 4,380,425 | | 4/1983 | Edelman | 425/458 |
| 4,694,843 | | 9/1987 | Casenhiser | 132/73 |
| 4,875,247 | | 10/1989 | Berg | 15/104.94 |
| 4,879,780 | | 11/1989 | Prebeck | 15/105.5 |
| 5,018,956 | | 5/1991 | Lemaster | 425/87 |
| 5,213,428 | | 5/1993 | Salman | 401/7 |
| 5,392,482 | | 2/1995 | Drulias et al. | 15/104.94 |
| 5,487,201 | | 1/1996 | Hansen et al. | 15/104.94 |
| 5,675,860 | | 10/1997 | Campbell | 15/235.7 |
| 5,678,273 | | 10/1997 | Porcelli | 15/104.94 |

* cited by examiner

*Primary Examiner*—Nam Nguyen
*Assistant Examiner*—Donald Heckenberg
(74) *Attorney, Agent, or Firm*—Fellers, Snider, Blankenship, Bailey & Tippens

(57) ABSTRACT

A device to assist in applying filler material into a gap, the device comprising of an elongated hollow body member adapted for receiving a human finger therein, the body having a substantially closed top end, an open bottom end, side walls, a front wall adapted to lie at the front of the finger, the front wall having a tapered thickness; and a back wall adapted to lie at the back of the finger, said front wall and the back wall being interconnected by the side walls.

4 Claims, 4 Drawing Sheets

DEVICE TO ASSIST IN APPLYING FILLER MATERIAL

REFERENCE TO PENDING APPLICATION

This application is based on U.S. Provisional Patent Application No. 60/071,772 filed on Jan. 18, 1998, entitled "FINGER THING".

REFERENCE TO MICROFICHE APPENDIX

This application is not referenced in any microfiche appendix.

BACKGROUND OF THE INVENTION

1. Field of the Invention

The present invention generally relates to a device adapted to assist in applying filler material into a gap joint and seams. More specifically, the present invention is directed toward a device which is placed over a finger which assists in applying filler material into a gap to form a seal.

2. Prior Art

The prior art indicates that the application of filler material, such as caulking material and the like, to joints, seams and gaps (collectively known hereafter as a "gap") have been accomplished through the use of a cartridge-type gun. Filler material is extended through a spout and is directed into the gap.

It is critical that these joints and seams provide a watertight and weatherproof seal to protect against infiltration of air and moisture. The application of the filler material through the use of the cartridge/spout process does not typically provide for a watertight and weatherproof coating. The user must attempt to direct the filler material into the desired placement by way of a handheld implement or his finger. The handheld implements typically involve a handle and a specially shaped head which allows for the filler material to be applied into the desired location within the seam or gap as well as provide a uniform looking exterior surface. See U.S. Pat. No. 5,675,860 issued to Campbell on Oct. 14, 1997 and U.S. Pat. No. 5,018,956 issued to Lemaster on May 28, 1991. Both devices utilize a handle portion with a specially made head.

When using a handheld implement, the user must first apply the filler material and then retrieve the handheld implement from its resting place. Once the filler material has been directed into the seam, the implement must then be returned to its resting place prior to any additional application of the filler material. This is a cumbersome and inefficient process. Thus, making the use of one's finger to be the most efficient way to apply filler material into a gap.

The advantage of using a finger over a handheld device can be seen in U.S. Pat. No. 4,380,425 issued to Edelman on Apr. 19, 1983. The Edelman device is a caulking spout attached to a cartridge. The spout has a finger-shaped applicator which attempts to assimilate the application of a filler material into a gap by use of a finger. This device, however, does not have the advantage of the user's sense of feel when applying the filler material into the gap.

The use of a user's finger is typically preferred over that of a handheld implement due to the ability of the user to quickly apply the filler material into the desired location while simultaneously creating a uniform exterior surface of the filler material. The use of one's finger, however, cannot be used over an extended period of time due to the unprotected nature of the user's finger.

The present invention solves the problem of applying filler material into a gap by the use of one's finger while simultaneously protecting that finger by providing a device which fits over one's finger which assists in the application of the filler material into the gap.

BRIEF SUMMARY OF THE INVENTION

The present invention is directed toward a device to assist in applying filler material into a gap. The device generally comprises a hollow body adapted to receive a human finger. This body can be made out of a flexible rubber-type material, such as methyl vinyl or synthetic gum material. The body has a substantially closed top end and an open bottom end, sidewalls, a front wall and a back wall. The front wall is adapted to lie at the front of the finger and has a tapered thickness. The back wall is adapted to lie at the back of a finger. The front wall and back wall are interconnected by the side walls. The tapered thickness extends the length of the body and is used to direct the filler material into the desired location.

The device protects the finger from the elements while providing a means in which to direct the filler material into the desired location within the gap.

DETAILED DESCRIPTION OF THE PREFERRED EMBODIMENTS

Figure 1:
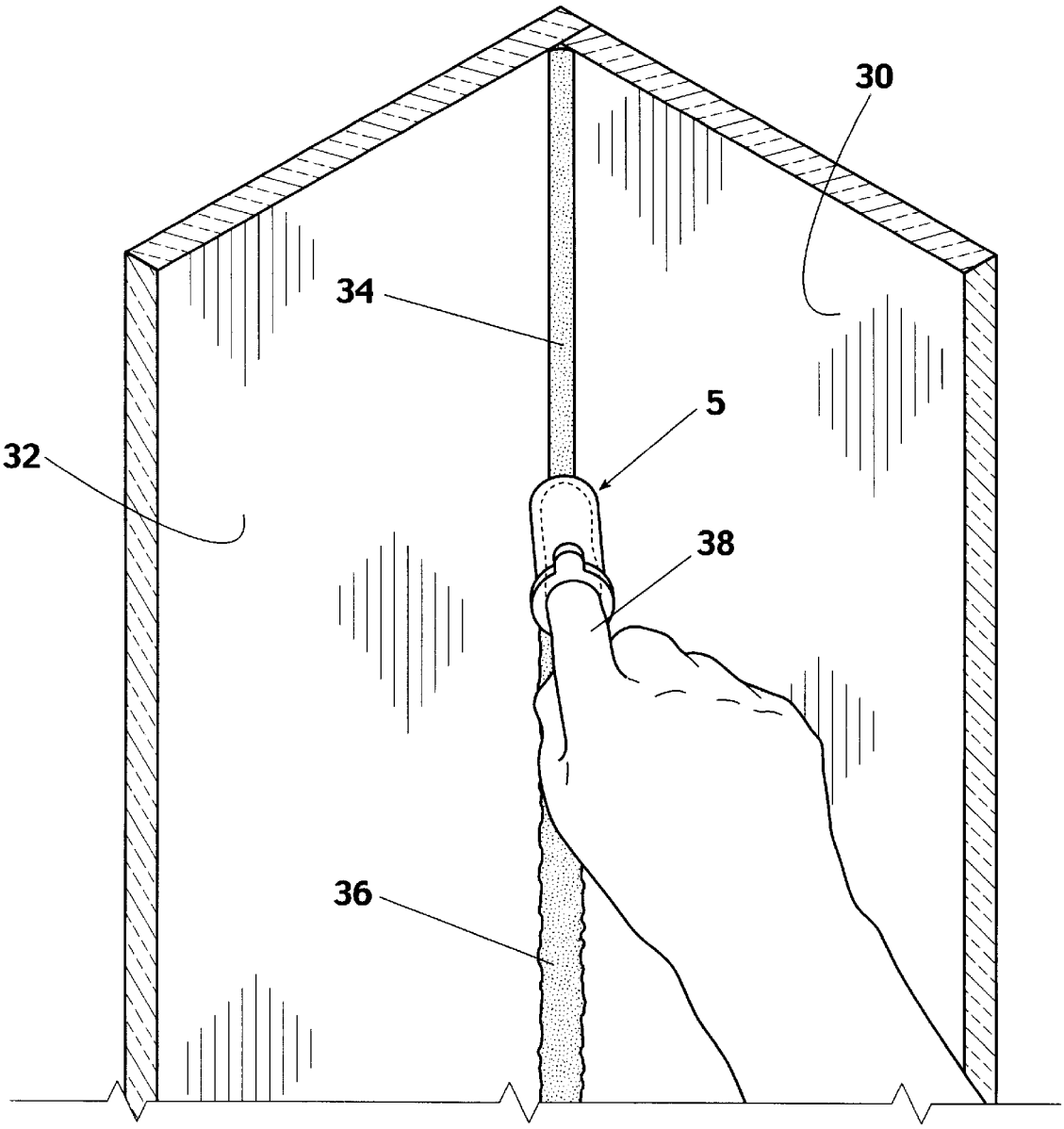
FIG. 1 is a prospective view of the present invention being used to assist filler material into a gap to form a seal between two pieces.
Figure 2:
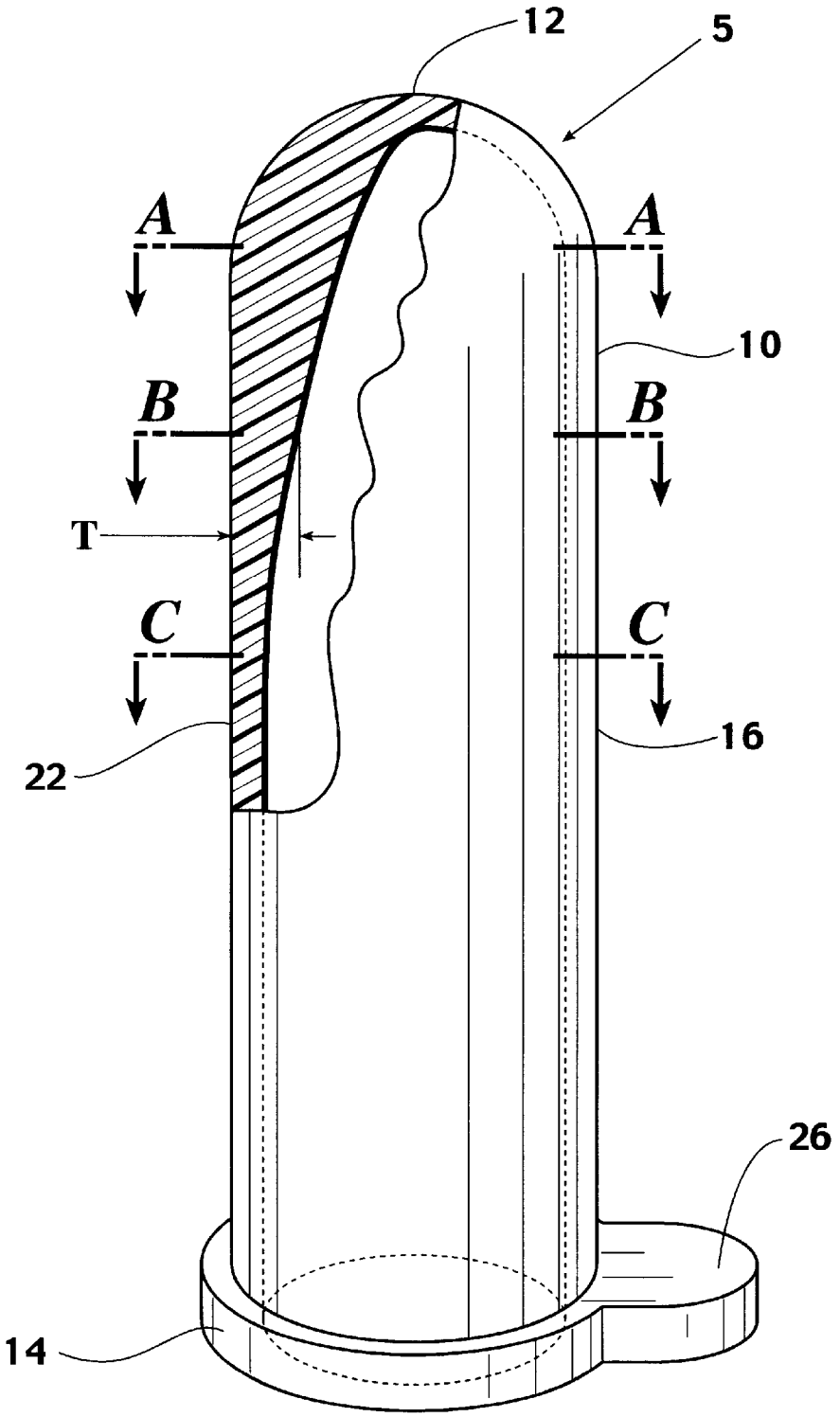
FIG. 2 is a side view of the present invention shown in FIG. 1.
Figure 4:
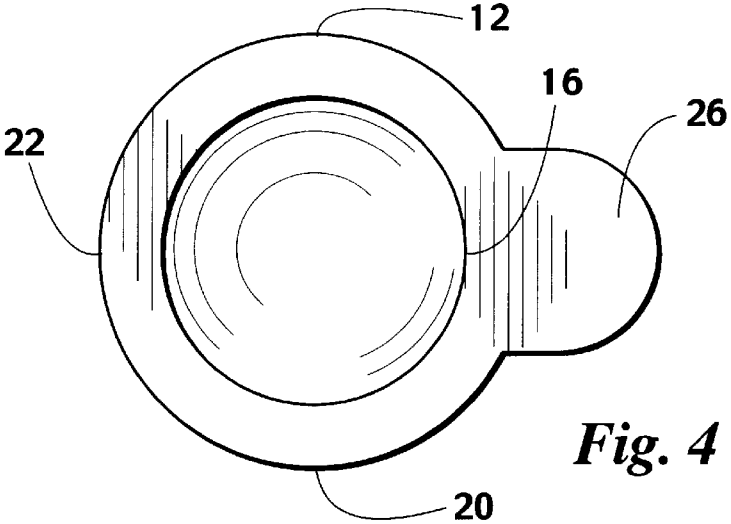
FIG. 4 is a bottom view of the present invention shown in FIG. 1.
Figure 3:
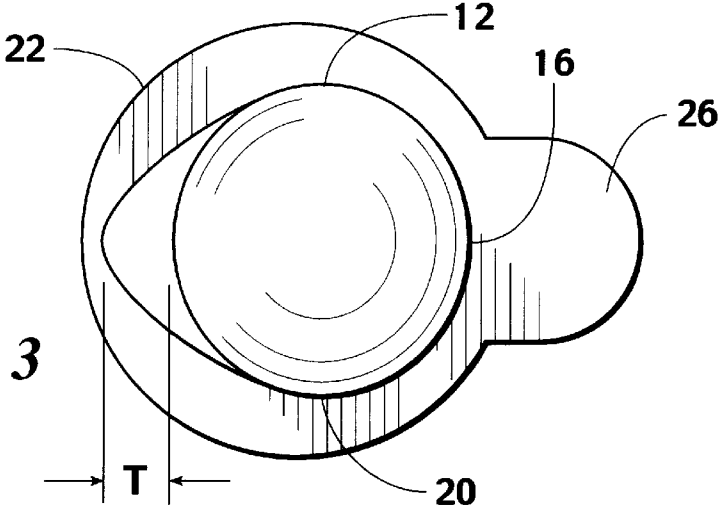
FIG. 3 is a top view of the present invention shown in FIG. 1.
Figure 8:
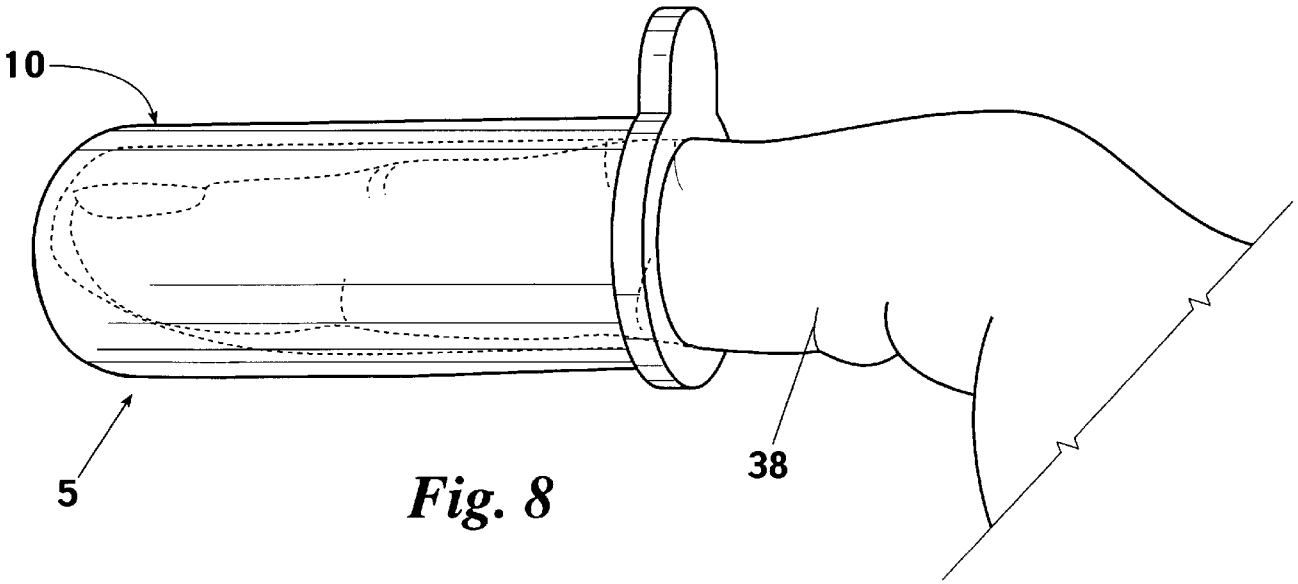
FIG. 8 is a side perspective view of the present invention.
Figure 5:
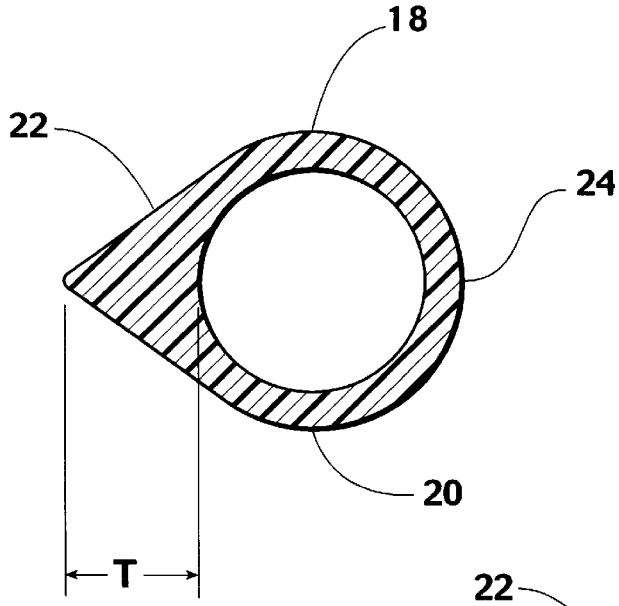
FIG. 5 is a cross-sectional view of the present invention about lines A—A in FIG. 2.
Figure 6:
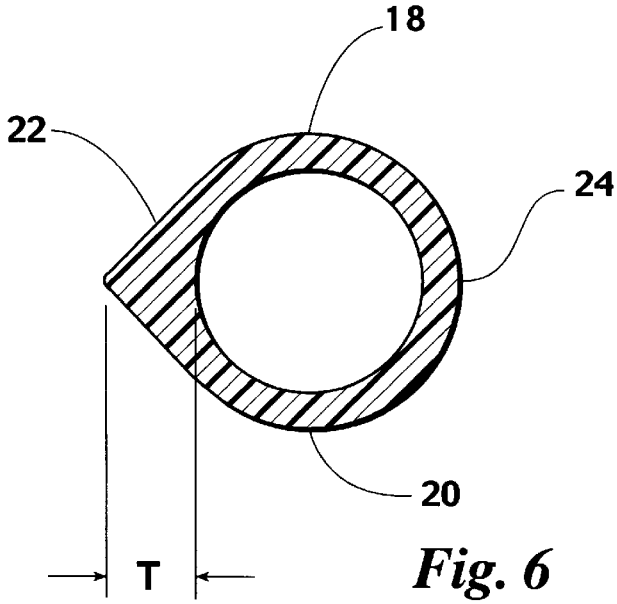
FIG. 6 is a cross-sectional view of the present invention along lines B—B in FIG. 2.
Figure 7:
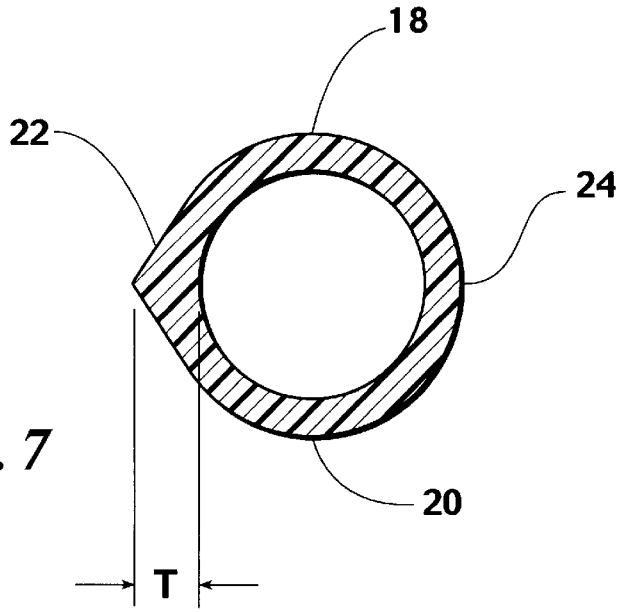
FIG. 7 is a cross-sectional view of the present invention along lines C—C in FIG. 2.

As previously described and as shown in the figures, the present invention is directed toward a device to assist in applying filler material into a gap to form a seal between two pieces. As shown in FIG. 1, the device 5 is placed over a user's finger 38 and assists in applying filler material 34 into a gap 36 between two pieces 30 and 32. The filler material can be a variety of material, such as caulking material to seal a corner joint, tile grout to fill and smooth the gap between two pieces of tile, as well as structural silicone sealant to apply to waterproof and weatherproof gaps between windows and the adjoining structure.

As shown in FIGS. 2 through 8, the device 5 comprises an elongated hollow member 10 having a top end 12 and a bottom end 14, side walls 18 and 20, a front wall 22 and a back wall 24. Front wall 22 and back wall 24 are interconnected by side walls 18 and 20.

Top end 12 is substantially closed, bottom end 14 is open to allow access of finger 38 into the interior of device S.

Front wall 22 has a tapered thickness T. Tapered thickness T allows the user to direct filler material 34 into gap 36. In the preferred embodiment, thickness T extends the longitudinal length of elongated member 10 and increases in thickness from bottom end 14 to top end 12.

In the preferred embodiment, pull tab 26 is connected to bottom end 14 and extends outwardly therefrom. Pull tab 26 facilitates the insertion of finger 38 into elongated member 10 as well as the removal of finger 38 therefrom.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A device to assist in applying filler material into a gap, said device comprising:

an elongated hollow body member for receiving a human finger therein, said body member having a closed top end, an open bottom end and a substantially cylindrical wall therebetween, said closed top end being located proximate to the distal portion of said human finger, said open base end being located proximate to the proximal portion of said human finger to allow for the insertion of said human finger into said elongated hollow body member, said substantially cylindrical wall having a thickness, said thickness being substantially uniform except along that portion of said substantially cylindrical wall located along to the volar portion of said human finger, said portion having a cross section defining a substantially parabolic shape extending outward from said volar portion of said human finger.

2. The device of claim 1 wherein the portion of said thickness having a cross section defining a substantially parabolic shape is further defined as increasing in thickness from said bottom end to said top end.

3. The device of claim 1 further comprising a pull tab connected to said bottom end and extending outward therefrom to facilitate the insertion of said device onto and from said human finger.

4. The device of claim 1 wherein the portion of said thickness having a cross section defining a substantially parabolic shape is further defined as forming a V-shape.

* * * * *